US005745547A

United States Patent [19]

Xiao

[11] Patent Number: 5,745,547

[45] Date of Patent: Apr. 28, 1998

[54] MULTIPLE CHANNEL OPTIC

[75] Inventor: Qi-Fan Xiao, Latham, N.Y.

[73] Assignee: X-Ray Optical Systems, Inc., Albany, N.Y.

[21] Appl. No.: 691,525

[22] Filed: Aug. 2, 1996

[51] Int. Cl.[6] ..... G21K 1/00

[52] U.S. Cl. ..... 378/145; 378/84; 250/505.1

[58] Field of Search ..... 378/84, 85, 145, 378/147, 149; 250/505.1

[56] References Cited

U.S. PATENT DOCUMENTS

| | | | |
|---|---|---|---|
| 5,001,737 | 3/1991 | Lewis et al. | 378/145 X |
| 5,101,422 | 3/1992 | Thiel et al. | 378/145 |
| 5,192,869 | 3/1993 | Kumakhov | 250/505.1 |
| 5,241,426 | 8/1993 | Mochimaru et al. | 378/145 X |
| 5,570,408 | 10/1996 | Gibson | 378/145 |

FOREIGN PATENT DOCUMENTS

| | | | |
|---|---|---|---|
| 0 723 272 A1 | 7/1996 | European Pat. Off. | G21K 1/06 |
| 43 39 666 C1 | 11/1993 | Germany | G21K 1/06 |
| WO 92/08235 | 5/1992 | WIPO | G21K 1/00 |

OTHER PUBLICATIONS

Guan-Jye Chen, R.K. Cole, F. Cerrina, "Image Formation in Capillary Arrays—The Kumakhov Lens," SPIE vol. 1924, 353–361 (1993).

H. Chen, R.G. Downing, D.F.R. Mildner, W.M. Gibson, M.A. Kumakhov, I Yu. Ponomarev & M.V. Gubarev, "Guiding and focusing neutron beams using capillary optics," Nature, vol. 357, 391–93(1992).

*Primary Examiner*—David P. Porta

*Attorney, Agent, or Firm*—Heslin & Rothenberg,P.C.; Wayne F. Reinke, Esq.

[57] ABSTRACT

A multiple-channel optic with each channel having a radius of curvature that varies directly with channel size (i.e., as the radius of curvature increases or decreases, so does the channel size, although not necessarily at the same rate).

8 Claims, 4 Drawing Sheets

MULTIPLE CHANNEL OPTIC

BACKGROUND OF THE INVENTION

This application claims the benefit of U.S. provisional application Ser. No. 60/001,806, filed Aug. 4, 1995.

Technical Field

This invention will find use in fields where intense focused radiation is required and will be particularly advantageous in situations requiring high precision spatial resolution of radiation. Another area of application is the analysis of very small samples, where intense focused radiation is advantageous.

Background Information

In the past, multiple-channel optics have had a constant radius of curvature. However, with the requirements for small focal spots from the multiple-channel optics, transmission efficiency has suffered. With a constant radius of curvature, transmission efficiency is less than optimum, unless the channel size is made impractically small. Moreover, manufacturing multiple-channel optics with channels of that size is not practical with conventional techniques.

Thus, a need exists for a way to improve transmission efficiency while achieving small focal spot size.

SUMMARY OF THE INVENTION

Briefly, the present invention satisfies the need for a multiple-channel optic with improved transmission efficiency by providing a multiple-channel optic with a varying radius of curvature, that increases or decreases together with channel size, but not necessarily at the same rate.

In accordance with the above, it is an object of the present invention to provide a multiple-channel optic with improved transmission efficiency compared to such optics of a practical size with a constant radius of curvature.

The present invention provides, in a first aspect, a multiple-channel optic where each channel has a radius of curvature that varies with channel size. The radius of curvature for each of the channels could, for example, increase or decrease as the channel size increases or decreases, respectively. Preferably, each of the channels may have a smooth inner wall. The profile of each channel could be, for example, elliptical. Further, the inlet and outlet therefor need not be the same size.

These, and other objects, features and advantages of this invention will become apparent from the following detailed description of the various aspects of the invention taken in conjunction with the accompanying drawings.

BEST MODE FOR CARRYING OUT THE INVENTION

As used herein, the term "radiation" refers to radiation or particles which, when incident on a material at or below an angle of critical value, undergoes essentially total external reflection. For example, the term "radiation" includes x-rays and neutrons. As used herein, the term "optic" refers to monolithic, or single-piece, multiple-channel optics which function as a result of multiple essentially total external reflections.

Figure 1:
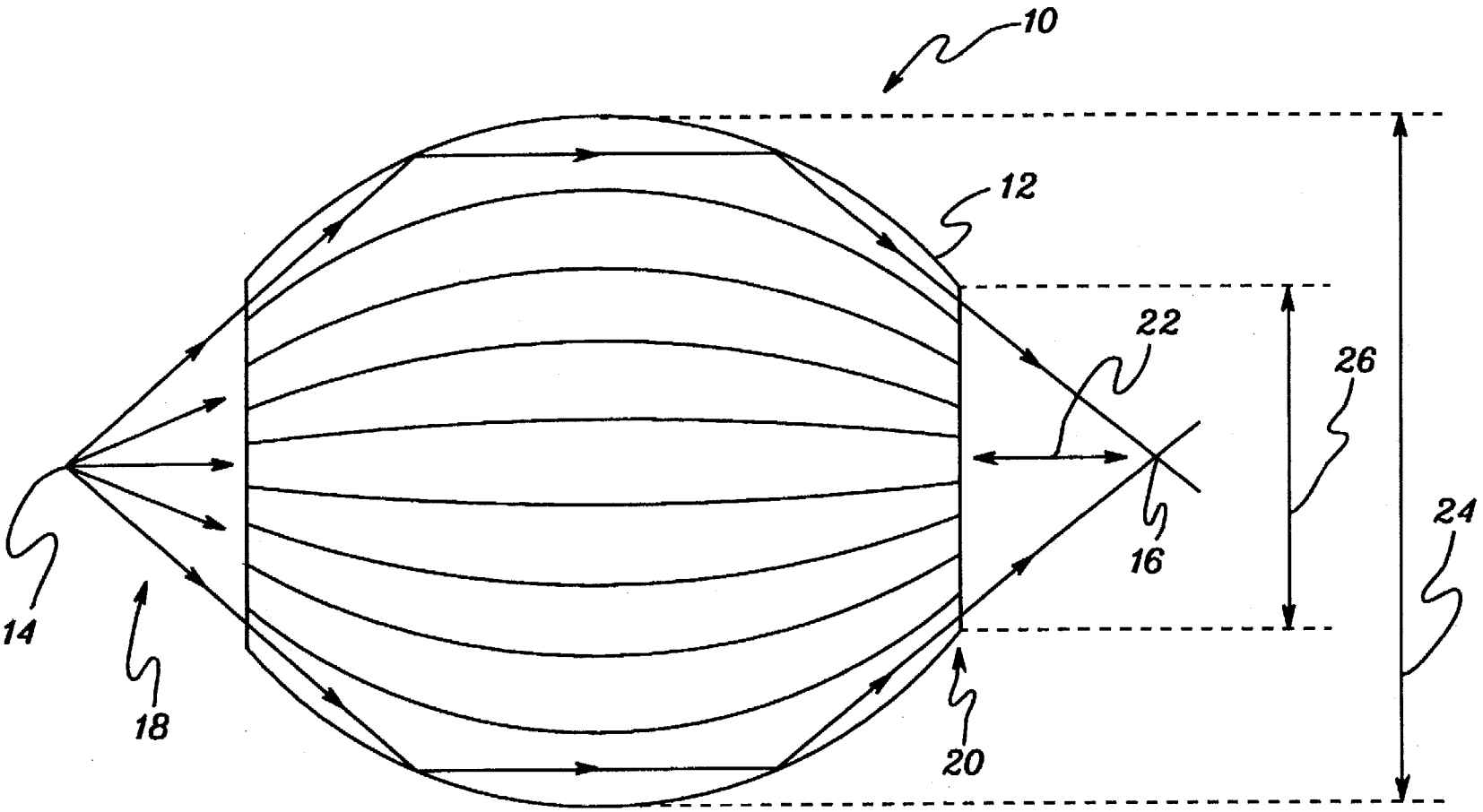
fig. 1 PRIOR ART
FIG. 1 is a cross-sectional view of a monolithic, multiple-channel optic.

FIG. 1 is a cross-sectional view of a monolithic, multiple-channel optic, such as that disclosed in U.S. Pat. No. 5,192,869 issued to Kumakhov and entitled, "Device for Controlling Beams of Particles, X-Ray and Gamma Quanta", which is herein incorporated by reference in its entirety. Optic 10 comprises a plurality of hollow capillaries or channels, such as channel 12, fused together as a roughly straight bundle, then formed into the shape shown in FIG. 1. The channels are preferably made of a material allowing a smooth inner wall for reflecting radiation, for example, glass.

Also shown in FIG. 1 is point source 14, focal point 16 and radiation 18. It will be understood that the cross-sectional shape of channel 12, and the other channels, are preferably circular, but could be other shapes, such as, for example, square. The goal of optic 10 is to collect as much of radiation 18 from point source 14 as possible and transmit a maximum amount of radiation 18 to the outlet end 20, via multiple essentially total external reflections. The transmitted radiation is then converging at focal point 16, some distance away from the outlet end 20. For a given channel in optic 10, such as channel 12, the radius of curvature is constant (i.e., the profile of each channel approximates a circular arc). The channel diameter changes approximately proportionally to the diameter of the optic along the axis of the optic, the axis running horizontally from inlet to outlet.

Transmission efficiency depends on channel diameter and radius of curvature. In particular, the channel diameter should be less than $((r\times\theta_c^2)+2)$, where "r" is the radius of curvature and $\theta_c$ is the critical angle for total external reflection (which depends on the type of channel material and the type of radiation), for efficient transmission. In order for there to be a small focal spot 16 at output end 20, distance 22 between focal point 16 and outlet end 20 of optic 10 needs to be relatively short, on the order of at least about 1 mm. To achieve a short distance 22, distance 24 must be significantly larger than distance 26, approximately 10 times or more larger. A circular bending of the channel will result in large transmission losses near the maximum channel diameter, since the minimum radius of curvature through which radiation can be effectively transmitted decreases with channel diameter. Thus, with a constant radius of curvature, transmission efficiency is less than optimum, unless the channel diameter is impractically small.

Figure 2:
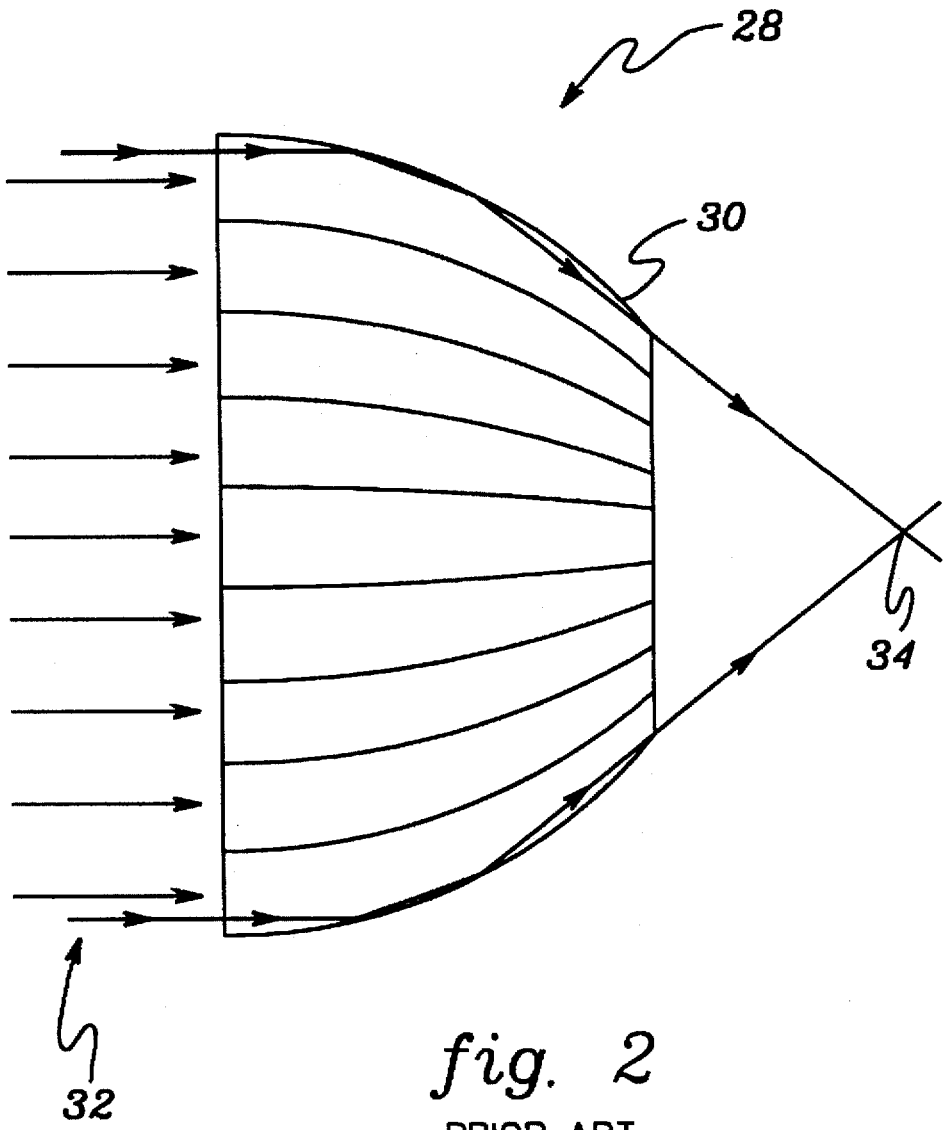
fig. 2 PRIOR ART
FIG. 2 is a cross-sectional view of another multiple-channel optic, effectively the right half of the optic of FIG. 1.

FIG. 2 depicts an optic 28, which is effectively the right half of the optic 10 of FIG. 1. Optic 28 comprises multiple channels, similar to optic 10. Quasi parallel incoming radiation 32 from a source, such as an x-ray beam produced by synchrotron radiation or a neutron beam exiting from a neutron guide, undergoes multiple essentially total external reflections as it is guided through the channels and exits optic 28 to converge at a focal point 34. The same problem described above with respect to optic 10 exists for optic 28.

Figure 3:
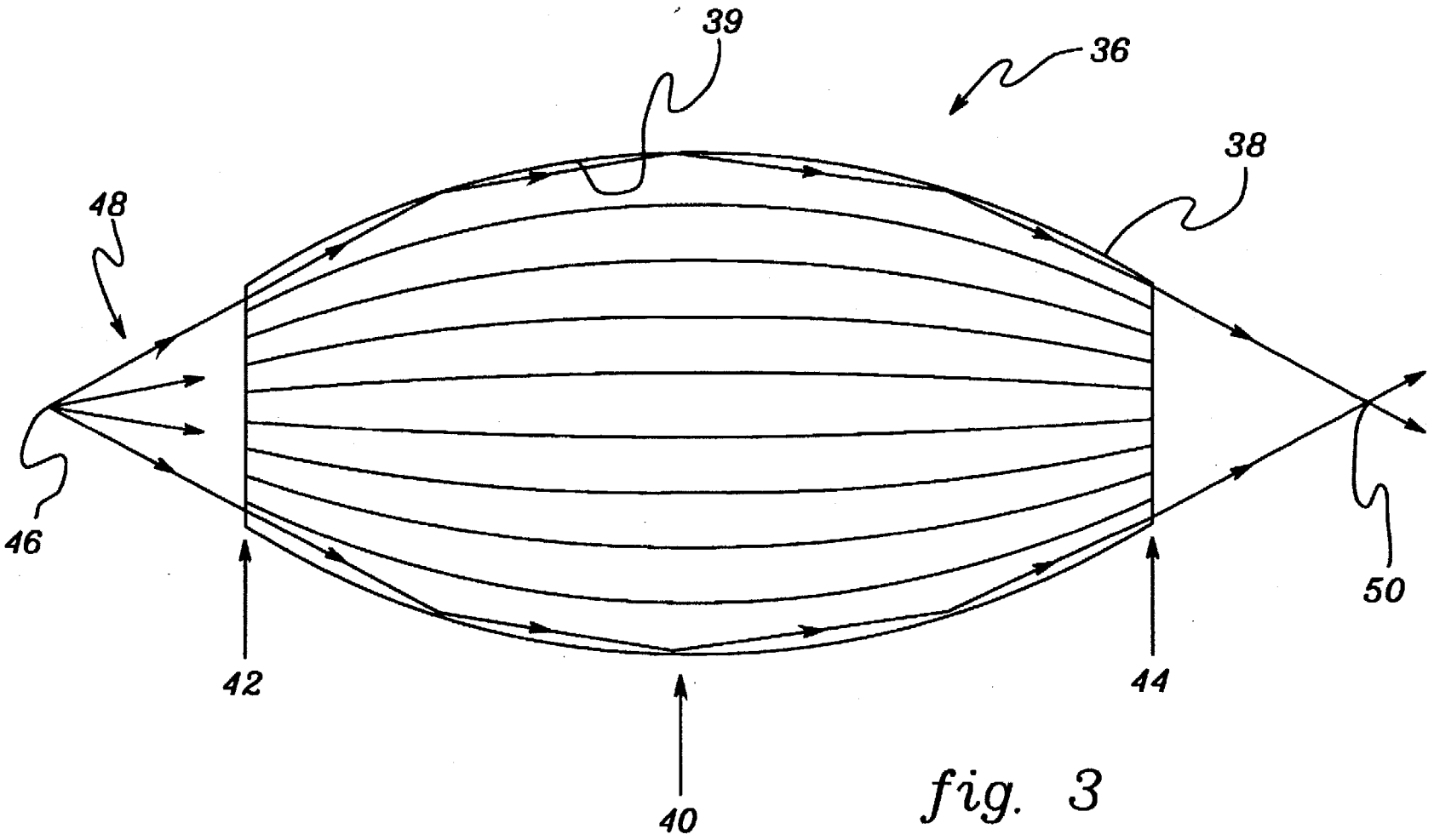
FIG. 3 is a cross-sectional view of a multiple-channel optic in accordance with the present invention.

The present invention solves the above-noted problem by changing the profile of the optic such that the radius of curvature is not constant, and increases or decreases together with channel size, but not necessarily at the same rate. FIG. 3 is a cross-sectional view of an optic 36 in accordance with the present invention. Optic 36 comprises a plurality of channels, for example, channel 38. In cross section, channel 38 may be, for example, circular or square. Channel 38 is preferably made of a material providing a smooth inner wall (e.g., inner wall 39) to minimize radiation losses and maximize radiation reflection within the channel, such as, for example, glass. A point source 46 emits radiation 48, which undergoes multiple essentially total external reflections as it is guided through the channels of optic 36 toward outlet 44 and converges at focal point 50.

The profile of each channel in FIG. 3 is elliptical, providing a higher optic transmission efficiency, since the radius of curvature increases or decreases with channel diameter. The radius of curvature for each channel is not a constant, as it was in the optic of FIG. 1, and is smallest at a place where the size of the optic is at a minimum. For the case of FIG. 3, the radius of curvature is smallest at inlet 42 and outlet 44, and is a maximum in the middle 40 of optic 36. It will be understood that the size of inlet 42 and outlet 44 need not be the same. It will also be understood that, although elliptical in FIG. 3, the profile of each channel in a multiple-channel optic of the invention, such as optic 36, need not be elliptical, but could be any shape where the radius of curvature changes with the channel size (i.e., increases or decreases together). For example, the channel profile could be cubic.

Figure 4:
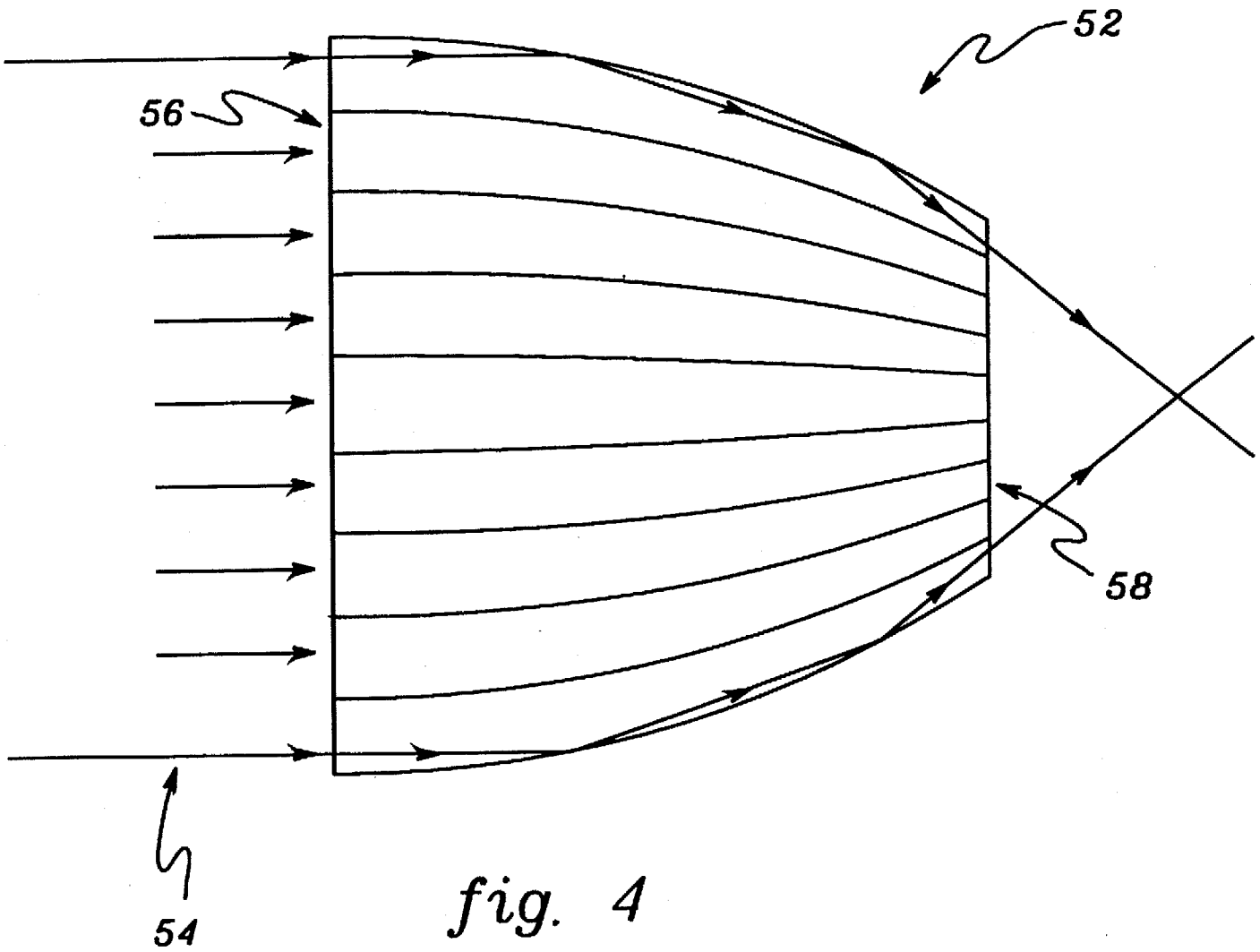
FIG. 4 is a cross-sectional view of another multiple-channel optic in accordance with the present invention, and is effectively the right half of the optic of FIG. 3.

FIG. 4 depicts optic 52 in cross-section, which is effectively the right half of optic 36 in FIG. 3 from the middle 40 thereof to the outlet 44. Optic 52 operates in a similar manner as optic 36, except that it is made for incoming quasi-parallel radiation 54, rather than diverging radiation from a point source. Thus, the inlet 56 is larger than the outlet 58.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

I claim:

1. A multiple-channel optic comprising a plurality of channels, each channel having a radius of curvature that varies with channel size.

2. The multiple-channel optic of claim 1, wherein the radius of curvature for each of the plurality of channels increases as the channel size increases.

3. The multiple-channel optic of claim 1, wherein the radius of curvature for each of the plurality of channels decreases as the channel size decreases.

4. The multiple-channel optic of claim 1, wherein each of the plurality of channels has a smooth inner wall.

5. The multiple-channel optic of claim 1, wherein each of the plurality of channels has an elliptical profile.

6. The multiple-channel optic of claim 1, wherein an inlet of the multiple-channel optic has a different size than an outlet of the multiple-channel optic.

7. The multiple-channel optic of claim 1, wherein the multiple-channel optic transmits x-rays.

8. The multiple-channel optic of claim 1, wherein the multiple-channel optic transmits neutrons.

* * * * *

UNITED STATES PATENT AND TRADEMARK OFFICE

CERTIFICATE OF CORRECTION

PATENT NO. : 5,745,547

DATED : April 28, 1998

INVENTOR(S) : Qi-Fan Xiao

It is certified that error appears in the above-identified patent and that said Letters Patent is hereby corrected as shown below:

Column 1, line 5, insert the following:

--This invention was made with U.S. government support under contract no. 70NANB2H1250 awarded by The Department of Commerce. The U.S. government has certain rights in the invention.--

Signed and Sealed this

Thirteenth Day of April, 1999

*Attest:*

Q. TODD DICKINSON

*Attesting Officer*

*Acting Commissioner of Patents and Trademarks*

US005745547C1

(12) EX PARTE REEXAMINATION CERTIFICATE (5800th)

United States Patent
Xiao

(10) Number: US 5,745,547 C1
(45) Certificate Issued: Jul. 3, 2007

(54) MULTIPLE CHANNEL OPTIC

(75) Inventor: Qi-Fan Xiao, Latham, NY (US)

(73) Assignee: X-Ray Optical Systems, Inc., Albany, NY (US)

Reexamination Request:
No. 90/007,063, Jun. 3, 2004

Reexamination Certificate for:

| | |
|---|---|
| Patent No.: | **5,745,547** |
| Issued: | **Apr. 28, 1998** |
| Appl. No.: | **08/691,525** |
| Filed: | **Aug. 2, 1996** |

Certificate of Correction issued Apr. 13, 1999.

Related U.S. Application Data

(60) Provisional application No. 60/001,806, filed on Aug. 4, 1995.

(51) Int. Cl.
*G21K 1/00* (2006.01)

(52) U.S. Cl. ..... 378/145; 378/84; 250/505.1

(58) Field of Classification Search ..... 378/84, 378/85, 145, 147, 149, 34, 35; 250/505.1
See application file for complete search history.

(56) References Cited

U.S. PATENT DOCUMENTS 5,175,755 A 12/1992 Kumakhov

OTHER PUBLICATIONS

Larson and Hostetler, Calculus with Analytic Geometry, alternate third edition. D.C. Heath and Company, Lexington, MA, 1986. pp. 776–777.*

J.B. Calvert, "Ellipse" <<www.du.edu>>/~jcalvert/math/ellipse.htm visited Aug. 11, 2005.*

R.P.Jangobegov et al., "Elemental Base of the X–Ray Guides," IV–th All–Union Conference on Interaction of Radiation with Solids, May 1990, p. 73, Moscow, USSR.

V.A. Arkad'ev et al., "Wide–band X–Ray Optics with a Large Angular Aperture," Sov. Phys. Usp. 32(3)), Mar. 1989, pp. 271–275, Moscow, USSR.

K.F. Voss et al., "A Capillary Concentrator for an X–ray Microprobe," Nuclear Instruments and Methods in Physic Research A 347, 1994, pp. 390–396, Elsevier Science Publishers B.V., North–Holland.

M.A. Kumakhov et al, "Multiple Reflection from Surface X–ray Optics," Physics Reports. Review Section of Physics Letters, vol. 191, No. 5, 1990, p. 333, Elsevier Science Publishers B.V., North–Holland.

M.A.Kumakhov et al., "Neutron beam steering by means of glass capillaries," IV–th All–Union Conference on Interaction of Radiation with Solids, 1990, p. 91, Moscow, USSR.

* cited by examiner

*Primary Examiner*—Kwang B. Yao

(57) ABSTRACT

A multiple-channel optic with each channel having a radius of curvature that varies directly with channel size (i.e., as the radius of curvature increases or decreases, so does the channel size, although not necessarily at the same rate).

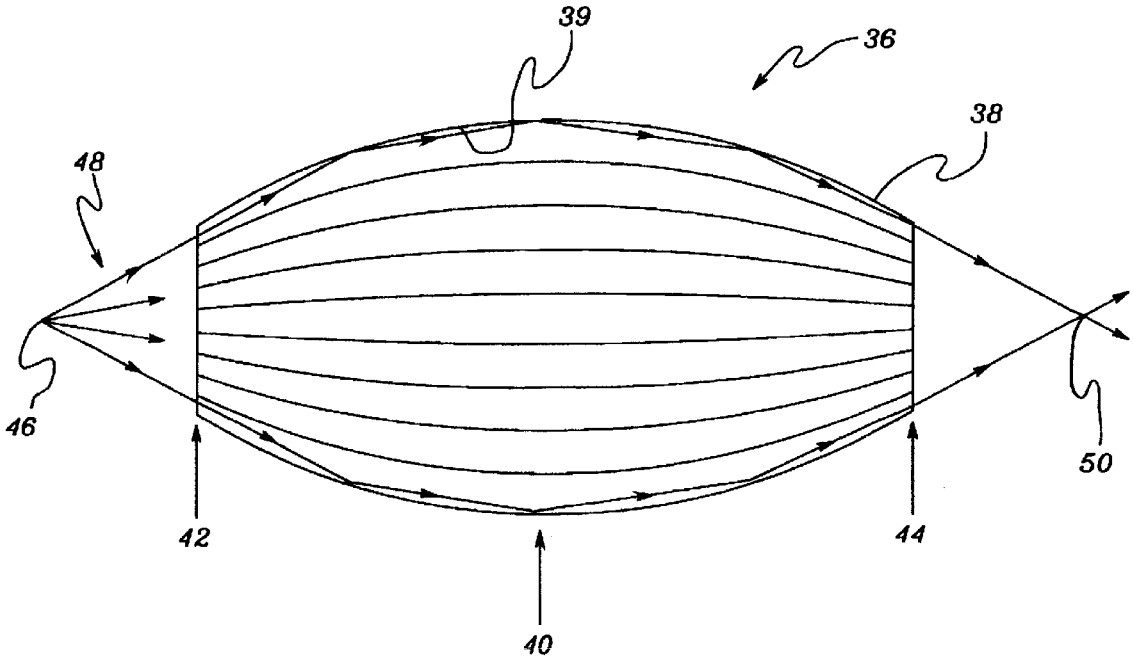

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2-8, dependent on an amended claim, are determined to be patentable.

1. A multiple-channel*, multiple total external reflection* optic comprising a plurality of channels, each channel having a radius of curvature that varies *together* with *changes in* channel size *over a region thereof having consistent concavity*.

* * * * *